United States Patent [19]

Hall

[11] Patent Number: 4,573,463

[45] Date of Patent: Mar. 4, 1986

[54] BREATHING MASK

[76] Inventor: Lester B. Hall, 249 Kinsey Ave., Kenmore, N.Y. 14217

[21] Appl. No.: 404,059

[22] Filed: Aug. 2, 1982

[51] Int. Cl.[4] ..... A62B 9/00; A62B 18/02

[52] U.S. Cl. ..... 128/205.24; 128/205.25; 128/206.28; 128/206.29; 128/207.11

[58] Field of Search ..... 128/201.26, 201.28, 128/205.22, 205.25, 206.12, 206.15, 206.21, 206.28, 206.29, 207.12, 207.14, 205.24, 205.21, 205.12, 207.18, 205.17

[56] References Cited

U.S. PATENT DOCUMENTS

| | | | |
|---|---|---|---|
| 439,093 | 10/1890 | Barain | 128/206.29 |
| 780,709 | 1/1905 | Craig | 128/207.18 |
| 1,695,170 | 12/1928 | Burdick . | |
| 2,012,441 | 8/1935 | Willson et al. | |
| 2,027,392 | 1/1936 | Manson | 128/206.29 |
| 2,383,649 | 8/1945 | Heidbrink | 128/206.29 |
| 2,418,036 | 3/1947 | Lane . | |
| 2,428,425 | 10/1947 | Levitt . | |
| 2,521,084 | 9/1950 | Obeito | 128/206.29 |
| 3,241,552 | 3/1966 | Giudice | 128/205.25 |
| 3,721,239 | 3/1973 | Myers | 128/205.17 |
| 4,281,652 | 8/1981 | Miller | 128/205.17 |

FOREIGN PATENT DOCUMENTS

| | | | |
|---|---|---|---|
| 829908 | 4/1938 | France | 128/206.29 |
| 1178552 | 12/1958 | France | 128/205.25 |
| 602071 | 2/1960 | Italy | 128/206.29 |
| 261470 | 11/1926 | United Kingdom | 128/205.25 |

*Primary Examiner*—Henry J. Recla
*Assistant Examiner*—Karin M. Reichle
*Attorney, Agent, or Firm*—Christel, Bean & Linihan

[57] ABSTRACT

Breathing apparatus comprising a body in the form of a mask shaped to be worn over a portion of a user's face, a breathing passage formed in the body having an outlet in one end only in communication with one of either the nose or the mouth of the wearer and having an inlet at the other end thereof, a container holding a quantity of gas for breathing adapted for connection to the mask body with the container outlet in communication with the breathing passage and the container releasing a flow of gas to the breathing passage when connected to the body, an exhalation passage defined by the body in communication only with the other of the mouth or nose of the user and being open to the atmosphere, and a mouthpiece element associated with the passage leading to the mouth and adapted to be received between the teeth of the wearer in gripping engagement to facilitate holding the apparatus in place on the head of the user. As a result, the user does not inhale from and exhale to the same chamber of the mask, and in the event straps or other conventional holding members on the mask should break, the user can hold the mask in place using his teeth. There is provided also a valve for controlling the flow of gas from the container as it is connected to the body.

8 Claims, 10 Drawing Figures

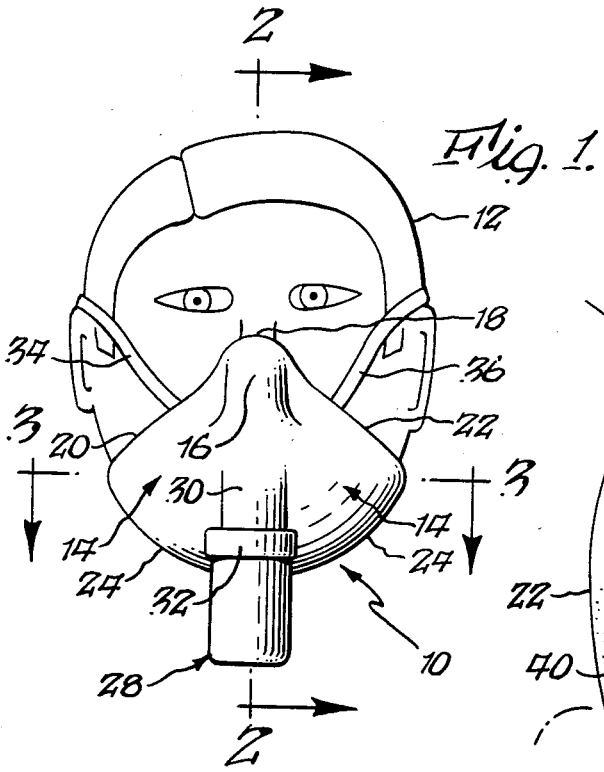
Fig. 1.
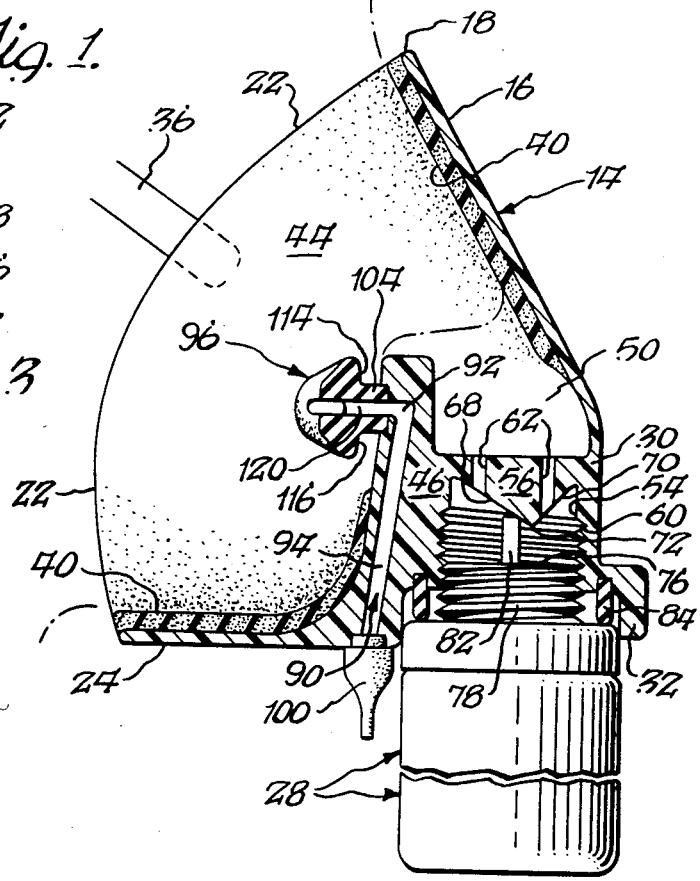
Fig. 2.
Fig. 3.
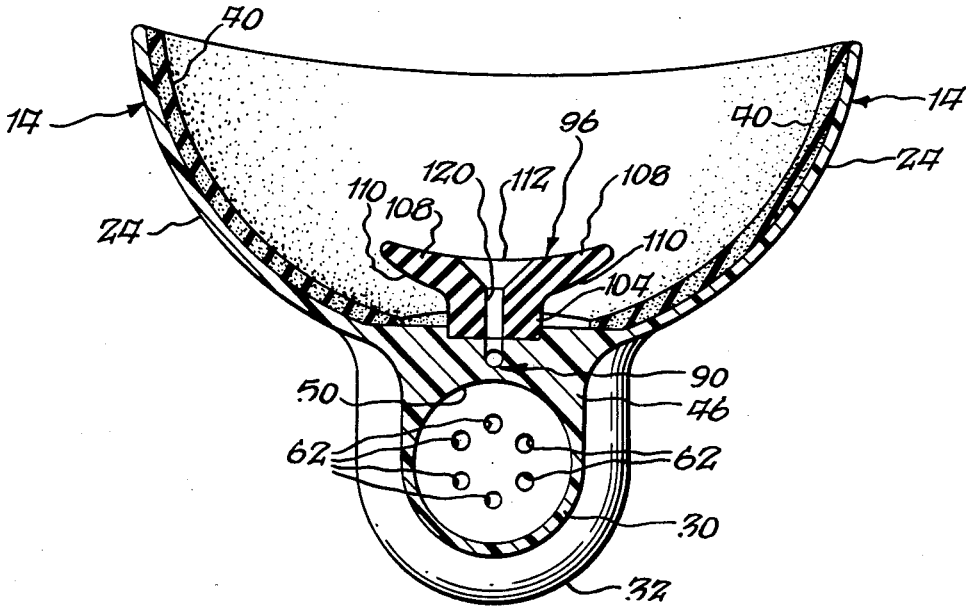

Fig. 4.
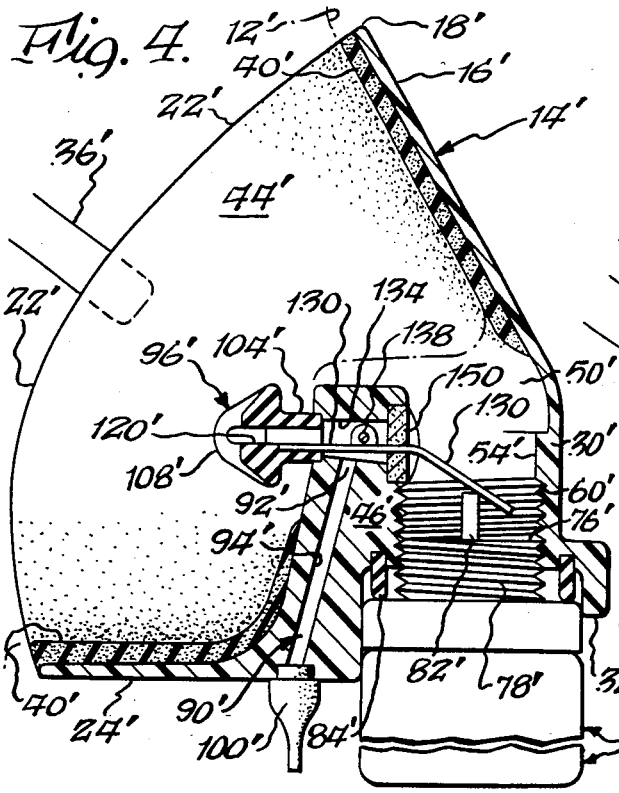
Fig. 6.
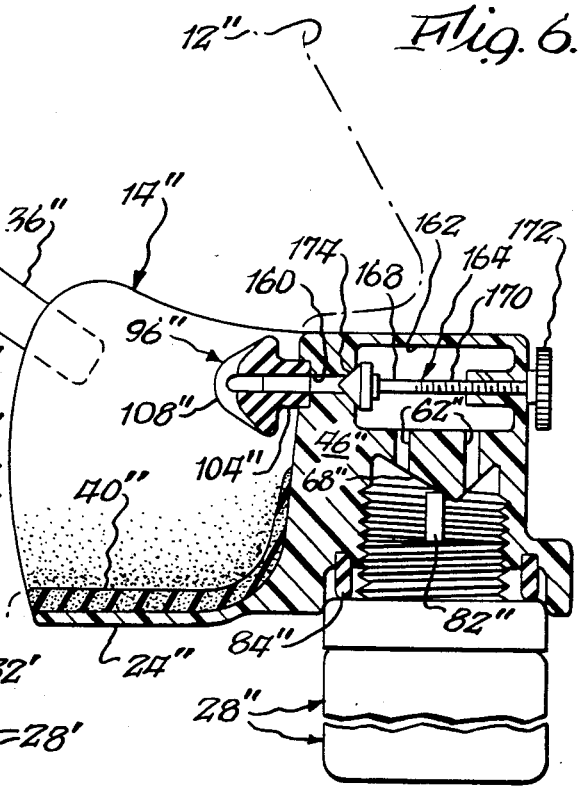
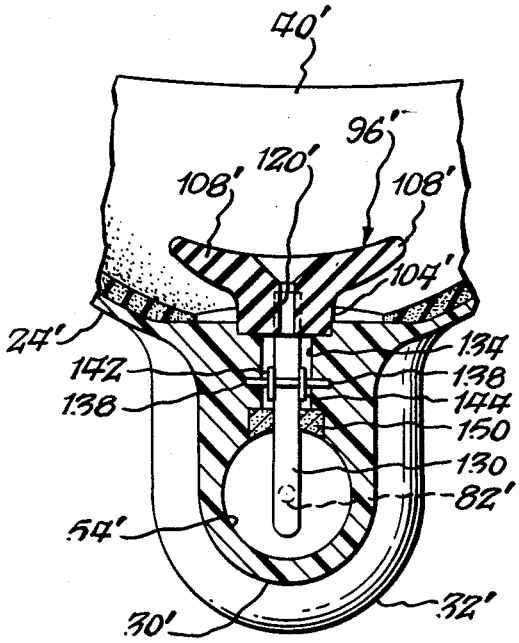
Fig. 5.
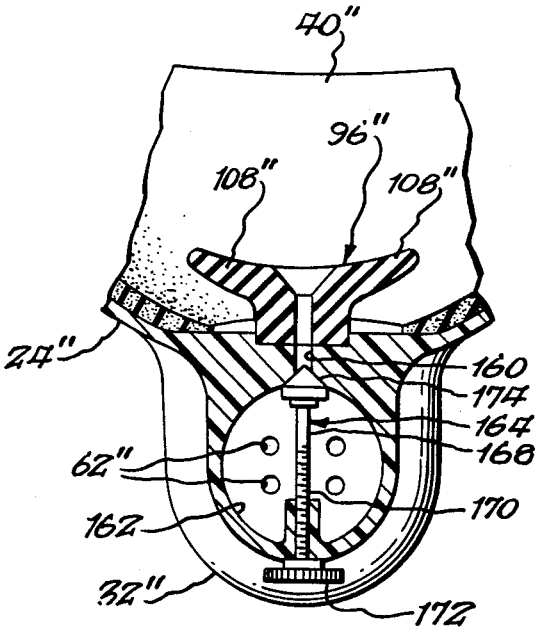
Fig. 7.

BREATHING MASK

BACKGROUND OF THE INVENTION

The invention relates to the art of breathing apparatus, and more particularly to a new and improved self-contained breathing apparatus in the form of a small-sized mask worn on the face of the user.

One area of use of the present invention is self-contained breathing apparatus to be worn by a user while moving about, although the principles of the invention can be variously applied. It would be highly desirable to provide breathing apparatus in the form of a mask and light weight oxygen supply which can be worn by a user while in a building in the event of a fire to protect the user against smoke inhalation. Such apparatus should be effective and safe in operation, light in weight and simple in construction. In addition, such apparaus should include structure which assures that it is maintained on the face of the user in operative position while the user moves about. In the event of severe fires and heavy smoke generation, in the event that a mask were to fall from the user's face such heavy smoke could hamper visibility and make it difficult for the user to retreive the breathing mask. In addition, it would be desirable to provide such apparatus wherein the user does not inhale from and exhale to the same chamber.

SUMMARY OF THE INVENTION

It is, therefore, a primary object of this invention to provide a new and improved self-contained breathing apparatus in the form of a mask and gas supply adapted to be worn on the face of the user.

It is a further object of this invention to provide such breathing apparatus particularly suited for use during fire conditions to protect the user against smoke inhalation.

It is a more particular object of this invention to provide such breathing apparatus having means to assure that the mask remains in a position of use on the face of the user as he moves about.

It is a more particular object of this invention to provide such breathing apparatus wherein the user does not inhale from and exhale to the same chamber of the apparatus.

It is a further object of this invention to provide a new and improved valve for controlling the supply of gas in such breathing apparatus.

It is a further object of this invention to provide such breathing apparatus which is effective and safe in operation and yet simple in construction.

The present invention provides breathing apparatus comprising a body in the form of a mask shaped to be worn over a portion of a user's face, a breathing passage formed in the body having an outlet in one end only in communication with one of either the nose or the mouth of the wearer and having an inlet at the other end thereof, a container holding a quantity of gas for breathing adapted for connection to the mask body with the container outlet in communication with the breathing passage and the container releasing the flow of gas to the breathing passage when connected to the body, an exhalation passage defined by the body in communication only with the other of the mouth or nose of the user and being open to the atmosphere, and means associated with the passage leading to the mouth and adapted to be received between the teeth of the wearer in gripping engagement to facilitate holding the apparatus in place on the head of the user. As a result, the user does not inhale from and exhale to the same chamber of the mask, and in the event straps or other conventional holding means on the mask should break, the user can hold the mask in place using his teeth. There is provided also a valve for controlling the flow of gas from the container as it is connected to the body.

The foregoing and additional advantages and characterizing features of the present invention will become clearly apparent upon a reading of the ensuing detailed description together with the included drawing wherein:

BRIEF DESCRIPTION OF THE DRAWING FIGURES

FIG. 1 is a front elevational view of breathing apparatus according to the present invention as it would appear in use worn on the face of a person;

FIG. 2 is a sectional view taken about on line 2—2 in FIG. 1 with some parts shown in elevation;

FIG. 3 is a sectional view taken about on line 3—3 in FIG. 1;

FIG. 4 is a sectional view, partly in elevation and similar to FIG. 2, showing breathing apparatus according to another embodiment of the present invention;

FIG. 5 is fragmentary sectional view of a portion of the apparatus of FIG. 4 taken in a manner similar to that of FIG. 3;

FIG. 6 is a sectional view similar to that of FIGS. 2 and 4 showing breathing apparatus according to another embodiment of the present invention;

FIG. 7 is a sectional view of a portion of the apparatus of FIG. 6 and taken in a manner similar to that of FIG. 5;

DETAILED DESCRIPTION OF THE ILLUSTRATED EMBODIMENTS

Figure 8:
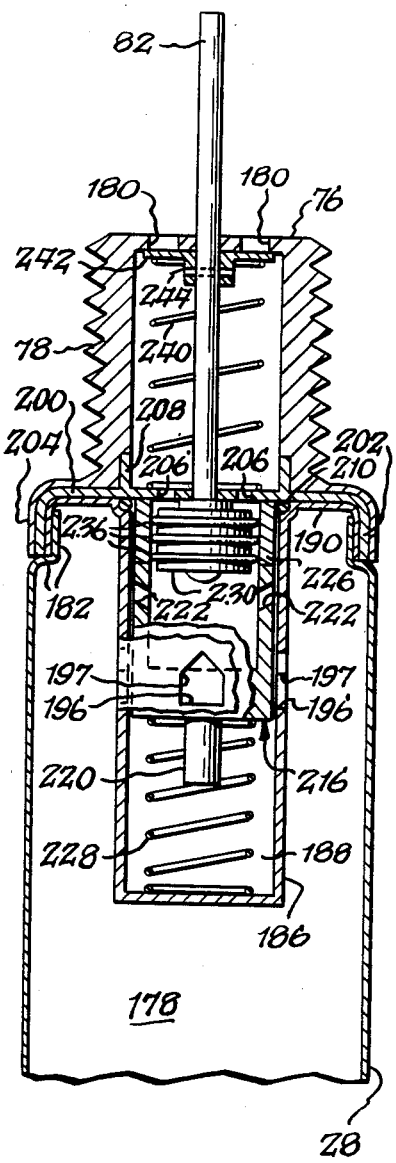
FIG. 8 is a fragmentary longitudinal sectional view of a valve for the gas supply container in the breathing apparatus of FIGS. 1–7 and showing the valve in a closed position.

FIG. 1 shows breathing apparatus generally designated 10 according to the present invention as it would appear in use worn on the face of a person 12. The apparatus includes a body 14 in the form of a mask shaped to be worn over a portion of the user's face. In the apparatus shown, the mask 14 is shaped to cover the nose and mouth area of a person. Mask 14 preferably is of plastic or like material and molded to include a formation 16 adapted to conform to the nose of the wearer. The formation 16 terminates in a curved edge 18 at the upper portion of the mask as viewed in FIG. 1, and the mask body terminates in a pair of side edges 20 and 22 extending from edge 18 along the corresponding cheek areas of the user's face toward the chin and neck area whereupon they meet a lower edge 24 associated with a surface which is shaped to conform to the chin and lower cheek area of the face.

The breathing apparatus further comprises a container 28 for holding a quantity of gas for breathing, typically oxygen, and the container is adapted for connection to body 12 for supplying the gas to the interior of the mask in a manner which will be described. Body 12 includes a formation 30 which terminates in a rim-like portion 32 into which container 28 is connected in a manner which will be described. As shown in FIG. 1, there is provided a pair of straps 34,36 for holding the apparatus 10 in place on the user's face. Each strap is fixed at one end to body 14 in the neighborhood of the corresponding edge 20,22 and is of a length enabling it to extend around the corresponding ear of the user and return for connection at the other end of the strap to a portion of the body 14 adjacent the lower edge 24. Other arrangements can of course be employed.

Referring now to FIG. 2, body 14 preferably is of relatively rigid plastic material or the like, and the interior surface of body 12 can be provided with a lining 40 in the form of a layer of thin cushioning material, for example foam rubber, for conforming more closely to the shape of the face of a particular wearer of the mask and for comfort. Other arrangements can of course be employed, for example a single material having sufficient structural integrity yet having some softness and flexibility to conform to the user's face thereby avoiding the need for separate cushioning material. The breathing apparatus of this embodiment of the present invention further comprises a breathing passage formed in body 14 having an outlet at one end in communication with only the nose of the wearer and having an inlet at the other end thereof. As shown in FIG. 2, body 14 is shaped to define a hollow interior region generally designated 44, and when the mask 14 is on the face of the user only the nose of the wearer is in communication with region 44 in a manner which will be described. The body 14 includes a relatively thicker solid portion 46 in the region of formation 30 and a breathing passage inlet 50 is defined therein.

The apparatus is provided with means for connecting container 28 to body 14 in a manner placing the container outlet in fluid communication with the breathing passage inlet 50. The body portion 46 is provided with a passage designated 54 which is generally cylindrical in shape and extends upwardly from the lower end of rim 32 as viewed in FIG. 2 and into the region including the formation 30 whereupon the passage terminates at a wall portion 56. The passage 54 is provided with internal threads 60. The wall 56 is provided with a series of through bores or passages 62 thereby providing fluid communication between the interior of passage 54 and the breathing passage inlet 50. The surface of wall 56 facing breathing passage inlet is generally planar and disposed substantially perpendicular to the axis of cylindrical passage 54. The opposite surface of wall 60 facing passage 54 includes a pair of angularly disposed surface portions 68 and 70 which extend into passage 54 and terminate in a pointed edge 72. One of the surfaces, such as surface 68, acts as a camming surface to open the valve of container 28 in a manner which will be described.

Container 28 is provided with a cylindrical neck portion terminating in an axial end face 76 having external threads 78 along the neck portion which engage with the threads 56 as the container is twisted or screwed into the mask body 14. A valve operator member 82 extends axially outwardly from end face 76. Thus, as will be described in detail presently, as container 28 is twisted or screwed into the mask body 14 member 82 engages camming surface 68 and the container valve is progressively opened thereby progressively releasing gas which flows through the openings 62 into the inlet end 50 of the breathing passage. An annular sealing gasket 84 is provided between container 28 and mask body 14 as shown in FIG. 2.

The breathing apparatus of the present invention further comprises an exhalation passage, and in this embodiment an exhalation passage designated 90 is formed in body 14 and has an inlet 92 at one end in communication with only the mouth of the user and has an outlet 94 open to the atmosphere. In accordance with the present invention, there also is provided means in the form of a mouthpiece element 96 associated with the portion of the mask body adjacent the user's mouth and adapted to be received between the teeth of the wearer in gripping engagement for holding the apparatus 10 in place on the head of the user. In this embodiment, mouthpiece 96 is associated with the exhalation passage inlet. In particular, exhalation passage 90 is in the form of a bore formed in the body portion 46 and the inlet 92 is at a location in body portion 46 so as to be generally near the mouth of the user when the apparatus is in place. The outlet 94 of passage 90 can be at various convenient locations, and in the device shown is near the lower end of body 14 and extends through the wall 24. A check valve 100 is fitted into the outlet 94 of passage 90 whereby the user can breathe only in an outward direction, i.e. toward the atmosphere, through the exhalation passage 90.

Mouthpiece 96 is a solid element of rubber or like material shaped to fit comfortably in the user's mouth. When mouthpiece 96 is in the user's mouth, only exhalation passage 90 is in communication with the users mouth. In other words, mouthpiece 96 prevents the user's mouth from being in communication with region 44. As shown also in FIG. 3 mouthpiece 96 has a central body portion 104 which is connected into the body portion 46. The mouthpiece 46 also has a generally curved or arcuate portion 108 extending from the body in generally opposite directions. The extending portion 108 has a forwardly facing convex surface 110 and a rearwardly facing concave surface 112. As shown in FIG. 2, convex surface 110 has an upper portion 114 above central body 104 and a lower portion 116 below central body 104. Thus, when mouthpiece 96 is received in the mouth the edges of the user's front teeth grip central body 104 and the inner surfaces of the front teeth contact the upper 114 and lower 116 portions of convex surface 110. As a result, when the user bites relatively firmly on the central body portion 104 to grip it between his front teeth, since mouthpiece 96 is fixed to mask body 14 this assures that the mask is maintained in place on the user's face. The mouthpiece 96 is provided with a central aperture 120 in communication with the exhalation passage inlet 92 thereby placing the mouth of the user in communication with the exhalation passage.

The breathing apparatus 10 of the present invention is operated in the following manner. Mask 14 and container 28 initially are separate and typically stored together in a package or kit. For example such packages could be provided for users in hotel rooms, offices in buildings and other typical areas of buildings occupied by persons. When it is desired to use the mask, such as in the event of a fire, container 28 is manually partially screwed into mask 14, enough to connect the two components together but not enough to initiate gas flow. Then mask 14 with container 28 connected thereto is placed on the head of the user as shown in FIG. 1 with breathing passage 44 in communication with only the user's nose and with mouthpiece 96 in the user's mouth and central body 104 thereof gripped between the user's teeth as previously described. As a result, the user's mouth is in communication with only the exhalation passage 90. Then container 28 is screwed or twisted further into mask body 14 causing camming surface 68 to move valve operator 82 as shown in FIG. 2 to open container 28 and admit a gradual flow of oxygen through bores 62 into breathing passage 44. The user breathes this oxygen in through his nose and exhales from his mouth through mouthpiece passage 120 and exhalation passage 90 through check valve 100. Container 28 is sized to hold a quantity of oxygen estimated to be sufficient for the duration of typical fire emergency situations. The flow rate provided by the container valve also is predetermined with this requirement in mind. The user inhales from and exhales to separate passages in the mask. The gripping of mouthpiece 96 between the user's front teeth complements the holding function of straps 34,36 and serves as a substitute holding means in the event the straps should happen to break. As an alternative use, the breathing apparatus can be worn by patients undergoing treatment in which case container 28 could hold oxygen or, alternatively, some gaseous medication.

FIGS. 4 and 5 show breathing apparatus according to another embodiment of the present invention. In this embodiment there is provided means operatively associated with the mouth piece and the valve operator member of the gas container whereby the user can control the rate of supply of gas to the breathing passage. For convenience in illustration, components in the embodiment of FIGS. 4 and 5 similar to those of FIGS. 1–3 are identified by the same reference numerals but with a prime designation. Thus, the embodiment of FIGS. 4 and 5 includes a mask 14' shaped to be worn over a portion of the user's face covering the nose and mouth area and preferably of plastic or like material and including a formation 16' adapted to conform to the nose of the wearer. The formation 16' terminates in a curved edge 18' at the upper end of the mask and the body terminates in a pair of side edges 20',22' which extend from the edge 18' along the corresponding cheek areas of the user's face toward the chin and neck area whereupon they meet a lower edge 24' shaped to conform to the chin and lower cheek area of the face.

A container 28' for holding a quantity of gas for breathing, typically oxygen, is adapted for connection to the body 14' for supplying the gas to the interior of the mask. Body 14' includes a formation 30' which terminates in a rim-like formation 32' into which container 28' is connected. A pair of straps, one of which is designated 36' in FIG. 4, holds the apparatus in place on the user's face in a manner similar to the preceding embodiment.

The interior surface of body 14' can be provided with a lining 40' in the form of a layer of thin cushioning material for conforming more closely to the shape of the face of a particular wearer of the mask and for comfort. Body 14' is shaped to define a hollow interior region 44', and when the mask is on the face of the user only the nose of the wearer is in communication with region 44'. A relatively thicker body portion 46' is located in the region of formation 30', and a breathing passage inlet 50' is defined therein. Portion 46' is provided with a cylindrical passage 54' extending upwardly from the lower end of rim 32' and into the region including formation 30', and passage 54' is provided with threads 60'. Container 28' is provided with a neck portion having external threads 78' which engage with the threads 56' as container is twisted into the body of the mask in a manner similar to that of the preceding embodiment. The container 28' terminates in an axial end face 76', and a valve operator member 82' extends axially beyond the end 80'. An exhalation passage 90' has an inlet 92 in communication with a mouthpiece element 96', and the outlet 94' of the passage has a check valve 100' associated thereiwth. Mouthpiece 96' has a central body portion 104', and extending body portion 108' and a central passage 120' in communication with exhalation passage inlet 92'.

In accordance with this embodiment of the present invention, there is provided link means movably connected to body 14' having one end operatively associated with the holding means or mouthpiece 96' and the other end operatively associated with the container valve operator 82' whereby gripping of holding means or mouthpiece 96' between the user's teeth moves the link means to move the operator member 82' to open the valve of the container. As shown in FIGS. 4 and 5, the link means comprises a lever 130 pivotally connected to body 14' intermediate the ends of the lever, one end of lever 130 being located in body portion 104 of mouthpiece 96 and the other end of lever 130 contacting operator member 82' of the container valve element. Lever 130 is of metal, plastic or other suitable rigid material, and in the device shown lever 130 is level or otherwise found to include two angularly disposed sections which meet at about midway of the length of lever 130. Body portion 46' is found to include an opening or passage 134 in which a portion of lever 130 is received. Body portion 104' of mouthpiece 96' is received in one end of passage 134, the lever portion extends axially along passage 134, and the end of lever 130 is embedded or otherwise fitted in body portion 104' of mouthpiece 96' as shown in FIGS. 4 and 5.

A pivot pin or rod 138 extends transversely of passage 134, being fixed at opposite ends in body portion 46' as shown in FIG. 5, and pin 138 carries a pair of guides 142,144 spaced axially along pin 138 between which lever 130 is received in a saddle-like fashion. In the device shown lever 130 is positioned below and in contact with pivot pin 138. The opposite end of passage 134 is closed by a plug element 150 of rubber or similar resilient material and lever 130 extends through plug 150. The material of plug 150 also is selected to provide a fluid-tight seal between passage 134 and the breathing passage inlet 50'. Exhalation passage 90' is in connection with passage 134 as shown in FIG. 4. In the device shown, the level or transition between the two longitudinal sections of lever 130 is adjacent plug 150, and the opposite end of lever 130 extends into breathing passage inlet 50' and is located to contact valve operator member 82'.

The breathing apparatus of FIGS. 4 and 5 operates in the following manner. Container 28' is screwed into body 14' and the mask body 14' and straps are placed on the face and head of the user in a manner similar to that of the embodiment of FIGS. 1–3. With container 28' inserted in body 14' to the point where valve operator 82' contacts the end of lever 130, as the user grips mouthpiece body portion 104' between his front teeth and bites down on body portion 104', the end of lever 130 in body portion 104' is moved upwardly as viewed in FIG. 4 and this movement is converted by the pivot 138 into downward movement of the opposite end of lever 130 moving valve operator 82' toward container 28′ to open the valve and admit gas to breathing passage inlet 50′. The user can control the degree of opening of the container valve and hence the rate of gas supply to the breathing passage by the degree to which he bites on the mouthpiece body portion 104′ gripped between his teeth.

In another mode of operation, the materials of body portion 104′ and plug 150 could be selected to impart an initial biasing force on lever 130 such that as container 28′ is screwed into mask body 14′ and valve operator 82′ contacts the end of lever 130, the biasing for on lever 130 would be sufficient to enable lever 130 to move operator 82′ as container 28′ is screwed further into mask 14′ to open the valve and release gas. Then, when the user bits on body portion 104′ this would result in an increase in the rate of supply of gas. Alternatively, mask body 14′ could be provided with structure in breathing passage inlet 50′ or a neighboring area which initially would engage valve operator 82′ as container 28′ is screwed into the mask to move operation 82′ initially to establish a preliminary rate of gas supply. Then this rate could be increased by the user biting on body 104′ to operate lever 150 to move operator 82′ further to increase the flow rate.

The breathing apparatus of FIGS. 4 and 5 includes the other attributes of the embodiment of FIGS. 1-3; namely, the user does not inhale from and exhale to the same passage and mouthpiece 96′ serves to complement or even substitute for the holding function provided by the straps.

FIGS. 6 and 7 show breathing apparatus according to another embodiment of the present invention. In this embodiment, the breathing passage is found in the mask body and is adapted to be in communication with the user's mouth. The mask defines an exhalation passage directly from the user's nose to the atmosphere. For convenience in illustration, components in the embodiment of FIGS. 6 and 7 similar to those of FIGS. 1-3 are identified by the same reference numerals but with a double prime designation. In this embodiment, mask body 14″ covers only the mouth and chin and neck area of the user, the nose being left exposed. The breathing passage is in the form of a small bore 160 in body portion 46″, and the breathing passage inlet is in the form of a chamber 162 in body portion 46″ between passages 62″ and breathing passage 160. There is provided manually operated valve means 164 for controlling the flow of gas supplied from container 28″ to breathing passage 160. The valve means 164 comprises a rod or shaft 168 threaded along one end 170 and received in body 14″ and having an externally accessable knob 172 on the outer end thereof. The opposite end of rod 168 is fixed in a valve element 174 adapted to fit into a valve seat formation in body portion 46″ at the entrance to breathing passage 160.

The apparatus is shown in FIGS. 6 and 7 with valve 164 in a seated or closed position blocking communication to breathing passage 160. The container 28″ is screwed into body 14″ and the mask body 14″ and straps are placed on the face and head of the user in a manner similar to that of the embodiment of FIGS. 1-3. The valve in container 28″ is opened in response to operator 82″ being moved by the action of camming surface 68″ in a manner similar to the embodiment of FIGS. 1-3. The user controls the rate of gas supply to breathing passage 160 by the amount he unseats or opens valve 164 simply by rotating knob 172 by hand. Thus, the user breathes gas such as oxygen from container 82″ in through his mouth and exhales through his nose directly to the atmosphere. The breathing apparatus of FIGS. 6 and 7 includes the other attributes of the embodiment of FIGS. 1-3; namely, the user does not inhale from and exhale to the same passage or region, and mouthpiece 96″ serves to complement or even substitute for the holding function provided by the straps.

Figure 9:
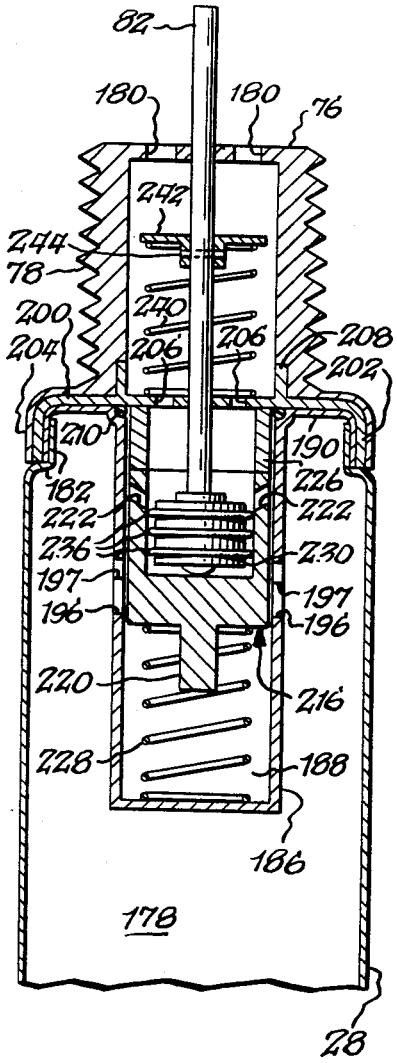
FIG. 9 is a view similar to FIG. 8 showing the valve in an intermediate position.
Figure 10:
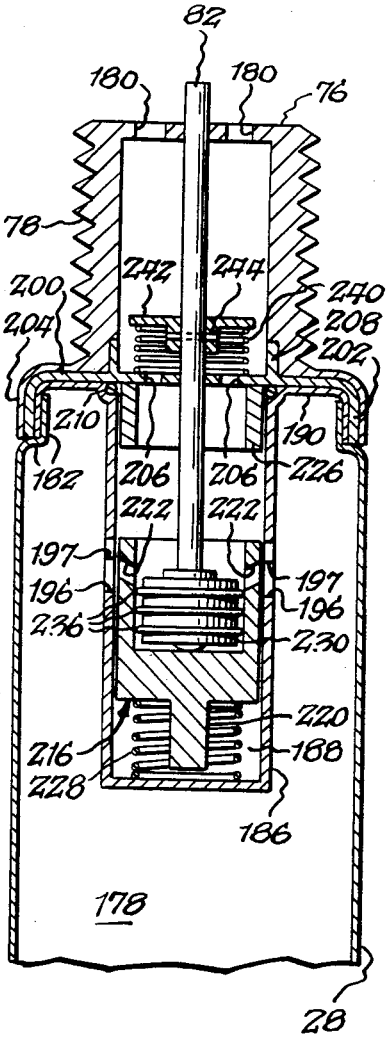
FIG. 10 is a view similar to FIGS. 8 and 9 showing the valve in an open position.

FIGS. 8-10 show a valve for use with the gas supply container 28 of the breathing apparatus of the present invention. FIG. 8 shows the valve in a closed position, FIG. 9 in an intermediate position and FIG. 10 in an open position. The container 28 is shown in FIGS. 8-10 and it is generally hollow cylindrical in shape as previously described having an interior 178 for storing gas under pressure and having a reduced diameter neck portion provided with the threads 78 for connection to the mask body 14 which neck terminates in an axial end face 76 as previously described. The container outlet is at the end including face 76 and is defined by a series of ports or openings 180 provided in end face 76. The valve operator in the form of rod 82 extends through a central opening in end face 76 for relative axial movement with respect to container 28 in a manner which will be described. Also, the wall of container 28 near the junction with the neck is bent or otherwise formed radially inwardly at the one end to define an annular recess or seat 182 to facilitate assembly of the components.

The valve includes a housing 186 which is located in container 28 between the interior 178 and the container outlet. The housing 186 includes a hollow interior region 188, and in the device shown housing 186 is generally hollow cylindrical in shape, closed at one end and open at the other with an annular skirt or flange 190 extending radially outwardly from the open end thereof and having aportion extending therefrom at generally a right angle for securement to the end of container 28 in the region of the recess and shoulder 182. In the device shown, housing 186 has a diameter approximately one-half the diameter of container 28 and an axial length several times less than the length of container 28. Housing 186 has first port means in the form of one or more openings 196 for placing the container interior 178 in fluid communication with the housing interior 188. The port means 196 can comprise a series of circumferentially spaced openings or ports around the perimeter of the cylindrical wall of housing 186. There is associated with housing 186 second port means for placing the housing interior 188 in fluid communication with the container outlet. In the device shown, a cap member 200 having an annular skirt or flange 202 is fitted between flange or skirt 190 and a corresponding flange or skirt 204 integral with and extending radially outwardly from the container neck portion. The skirts or flanges 190,202,204 are welded or otherwise secured together and to the recess and shoulder 182. The second port means for housing 186 is provided by a series of ports or openings 206 an the central wall portion of cap member 200. In the device shown, cap 200 can be provided with an annular upstanding rim or flange 208 which is received in a corresponding annular recess in the container neck portion. An O-ring 210 also is provided between the housing flange 190 and the cap 200 to enhance the fluid-tight seal therebetween.

The valve further comprises a flow control member or element generally designated 216 which is movable within housing 186 between a first position closing the port means 196 as shown in FIG. 8 and a second position opening the port means 196 as shown in FIG. 10. In particular, the flow control element 216 is generally in the form of a cylindrical cup open at the end facing cap 200 and closed at the end facing the closed end of housing 186. Element 216 is provided with a stop member 220 generally centrally of and extending a short distance axially outwardly from the closed end wall thereof. The flow control element 216 includes port means in a form of a series of circumferentially spaced openings or apertures 222 which are located near the annular edge or end face defining the open end of the cup shaped element 216. In addition, the openings 222 are so located axially along the element 216 and element 216 is of such axial length to provide closing of port means 196 in the position shown in FIG. 8 and opening of port means 196 as shown in FIG. 10 when the element 216 is moved to the second position.

In the closed condition of the valve illustrated in FIG. 8, the annular end face of member 216 abuts against a sleeve 228 fixed to cap 200 such as by welding or formed integrally with cap 200 for a purpose to be described. Member 216 is held in the port closing position of FIG. 8 by biasing means in the form of a coil spring 228, one end of which contacts the closed end wall of housing 186 and the other end of which is received around the stop member 220 and contacts the closed end wall of flow control element 216.

The valve further comprises operator means movable between a first position as shown in FIG. 8 and a second position moving the flow control member 216 to a port opening position as shown in FIG. 10. The operator means includes the rod-like operator member 82 and a piston member 230 fixed to an end of rod 82 and movable within the flow control member 216. In particular, rod 82 has one end located externally of the container and neck to which end a moving mechanical force may be applied. Rod 82 extends through a central opening in the end face 76 which opening is radially within the ports 180. Rod 82 extends further axially along within the container neck portion, substantially along the longitudinal axis of the container, and extends also through a central opening in the cap member 200, which opening is located radially within the ports 204. Thus, the other end of rod 82 is within the container, and piston 230 is fixed to that end of rod 82. Piston 230 is provided with a plurality, in the present instance three, O-rings 236 axially spaced therealong for providing a fluid-tight seal between piston 230 and the sleeve 226 when the valve is in the closed position. The operator means is urged to the closed position of FIG. 8 by biasing means in the form of a coil spring 240 located within the container neck portion. One end of spring 240 contacts the surface of cap 200 and the other end of spring 240 contacts a generally disc-shaped retainer 242 fixed to rod 82 by a pin 244.

The valve of FIGS. 8–10 operates in the following manner. In the position of FIG. 8 the valve is closed blocking fluid communication between the container interior 178 and the container outlet openings 180. In order to open the valve, operator member 82 must be moved in an axial inward direction toward container 28. This can be accomplished, as previously described, by screwing the container 28 into the mask body such that the camming surface 68 moves the rod 82 in the aforementioned direction. Of course, other structures and modes of operation can be employed to provide such axial inward movement of rod 82. FIG. 9 shows the valve in an intermediate position corresponding to some movement of rod 82 in the aforementioned direction. In particular, FIG. 9 shows that rod 82 has been moved a relatively short distance against the force of spring 240 thereby moving piston 230 from the position of FIG. 8 to a position where it is in contact with the solid inner axial end wall of flow control element 216. After this much movement of rod 82 and piston 230, however, there is no movement of the flow control element 216 and consequently the ports 196 are still closed. Then, upon further axial inward movement of rod 82, piston 230 moves flow control element 216 against the force of spring 228 axially along within housing 216 to the position of FIG. 10 where stop 220 abuts the axial end wall of housing 186 and the openings 222 of the flow control element 216 are in registry or communication with the ports 196 of housing 186. As a result, pressurized gas from the container interior 178 flows through parts 196 and the aligned openings 222 into the interior of flow control element 216 and the interior of housing 186 whereupon the gas flows outwardly throug openings 206 in cap 200 and axially along through the hollow interior of the container neck portion and out through the container outlet openings 180 for use and consumption, for example into the breathing passage of the mask 14 previously described. The openings 196 have a pointed or arrow-like end portion terminating in edge 197 whereby as piston 230 moves element 216 to initially place openings 220 in registry with openings 196, the openings 220 encounter an initially increasing area of the corresponding opening 196. Thereafter, when operator member 82 is allowed to move in the opposite direction i.e. returned by the force of spring 240, the flow control element 216 is returned to the position of FIG. 8 by the force of spring 228 thereby blocking fluid communication between the container 178 and the outlet ports 180. In this position, the O-rings 236 carried by piston 230 provide a fluid-tight seal with the inner surface of sleeve 226 thereby enhancing the fluid-tight seal provided by the valve when attached to container 28. To facilitate ease of manufacture, the valve components and threaded neck portion can be assembled as a unit which then subsequently can be inserted in the open end of container 28 and the combination of flanges or skirts 190,202 and 204 can be secured by appropriate crimping and cementing or welding to the container recess or seat 182.

It is therefore apparent that the present invention accomplishes its intended objects. While several embodiments of the present invention have been described in detail, this is for the purpose of illustration, not limitation.

I claim:

1. Breathing apparatus comprising:

(a) a body in the form of a mask shaped to be worn over a portion of a user's face;

(b) a breathing passage formed in said body having an outlet at one end adapted to be in fluid communication with only the nose of the wearer and having an inlet at the other end thereof;

(c) a container holding a quantity of gas for breathing and having an outlet, said body having means for connection to said container with said container adjacent to and supported exclusively by said body and said container outlet being in fluid communication with said breathing passage inlet, said container releasing a flow of gas to said breathing passage and thereby to only the nose of the wearer;

(d) an exhalation passage defined by said body separate from said breathing passage having an inlet at one end adapted to be in fluid communication with only the mouth of the user so that the user does not inhale from and exhale to the same passage in said body, said exhalation passage having an outlet open to the atmosphere; and (e) holding means on said body connected to said exhalation passage inlet and adapted to be received between the teeth of the wearer in gripping engagement for holding said apparatus in place on the head of the user and adapted for sealing engagement with the mouth of the user for allowing the user to exhale exclusively therethrough from the mouth to the exhalation passage.

2. Apparatus according to claim 1, further including check valve means operatively associated with said exhalation passage for allowing flow through said passage only in a direction from inlet to outlet.

3. Apparatus according to claim 1, further including strap means connected to said body for placement on the head of the user for further holding said apparatus in place.

4. Apparatus according to claim 1, wherein said container includes valve means for controlling the opening of said outlet and said means for connection to said container is further adapted to engage of said valve means as said container is connected to said body for opening said container outlet to release gas to said breathing passage.

5. Apparatus according to claim 4, further including connecting means on said container outlet for allowing, in combination with the means for connection to said container, progressive connection of said container outlet to said body and causing progressive engagement of said valve means by said means for connection to said container and thereby progressive opening of said outlet.

6. Apparatus according to claim 1, wherein said holding means comprises a resilient mouthpiece adapted to be received in the user's mouth between the user's teeth in gripping engagement and sized and shaped to seal with the user's mouth, said mouthpiece having passage means therethrough for allowing the user to exhale exclusively through said mouthpiece to said exhalation passage.

7. Apparatus according to claim 1, wherein said container includes valve means for controlling the opening of said outlet and further includes link means movably connected to said body and operatively connected with said holding means and said valve means for moving said valve means to open the outlet of said container when said holding means is gripped between the user's teeth.

8. Apparatus according to claim 7, wherein said holding means comprises a resilient mouthpiece adapted to be received in the user's mouth between the user's teeth in gripping engagement and sized and shaped to seal with the user's mouth, said mouthpiece having passage means therethrough for allowing the user to exhale exclusively through said mouthpiece to said exhalation passage and wherein said valve means includes an operator member and said link means comprises a lever pivotally connected to said body intermediate the ends of said lever, one end of said lever being located within and connected to said mouthpiece and the other end of said lever contacting said operator member of said valve means.

* * * * *